US008426988B2

(12) United States Patent
Hay

(10) Patent No.: US 8,426,988 B2
(45) Date of Patent: Apr. 23, 2013

(54) APPARATUS AND METHOD FOR GENERATING POWER DOWNHOLE

(75) Inventor: Richard T. Hay, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 457 days.

(21) Appl. No.: 12/681,089

(22) PCT Filed: Jul. 16, 2008

(86) PCT No.: PCT/US2008/070120

§ 371 (c)(1),
(2), (4) Date: Mar. 31, 2010

(87) PCT Pub. No.: WO2010/008382

PCT Pub. Date: Jan. 21, 2010

(65) Prior Publication Data

US 2010/0219646 A1 Sep. 2, 2010

(51) Int. Cl.
*E21B 41/00* (2006.01)

(52) U.S. Cl.
USPC ..... 290/1 R; 166/66.5

(58) Field of Classification Search ..... 290/1 R
See application file for complete search history.

(56) References Cited

U.S. PATENT DOCUMENTS

| | | | | |
|---|---|---|---|---|
| 3,588,804 A | | 6/1971 | Fort | |
| 3,970,877 A | * | 7/1976 | Russell et al. | 310/339 |
| 4,518,888 A | | 5/1985 | Zabcik | |
| 4,595,856 A | | 6/1986 | Glomb, Jr. | |
| 5,361,240 A | * | 11/1994 | Pearce | 367/157 |
| 5,477,101 A | * | 12/1995 | Ounadjela | 310/334 |
| 5,839,508 A | * | 11/1998 | Tubel et al. | 166/65.1 |
| 6,131,659 A | * | 10/2000 | Johnson | 166/250.05 |
| 6,144,316 A | * | 11/2000 | Skinner | 340/853.7 |
| 6,354,146 B1 | * | 3/2002 | Birchak et al. | 73/61.79 |
| 6,504,258 B2 | | 1/2003 | Schultz et al. | |
| 6,580,177 B1 | | 6/2003 | Hagood, IV et al. | |
| 6,768,214 B2 | * | 7/2004 | Schultz et al. | 290/1 R |
| 6,909,224 B2 | | 6/2005 | Ghandi et al. | |
| 7,234,519 B2 | | 6/2007 | Fripp et al. | |
| 7,246,660 B2 | * | 7/2007 | Fripp et al. | 166/65.1 |

(Continued)

FOREIGN PATENT DOCUMENTS

| | | |
|---|---|---|
| CA | 2563039 A1 | 4/2007 |
| EP | 0681090 B1 | 12/2002 |

(Continued)

OTHER PUBLICATIONS

UK Examination Report, dated Feb. 18, 2011, Application No. GB1003992.3, "Apparatus and Method for Generating Power Downhole", UK filed Mar. 10, 2010.

*Primary Examiner* — Joseph Waks
(74) *Attorney, Agent, or Firm* — W. Schmidt

(57) ABSTRACT

A downhole power generator has a substantially tubular body. A cover surrounds at least a portion of the body. At least one piezoelectric element is disposed in a cavity in the body, the piezoelectric element acting cooperatively with the cover such that motion of the cover relative to the body causes the piezoelectric element to generate electric power. A method for generating power downhole comprises disposing a cover around at least a portion of a substantially tubular body; disposing at least one piezoelectric element in the body; and engaging the piezoelectric element with the cover such that motion of the cover relative to the body causes the piezoelectric element to generate electric power.

18 Claims, 10 Drawing Sheets

U.S. PATENT DOCUMENTS

| | | | | |
|---|---|---|---|---|
| 7,864,629 | B2 * | 1/2011 | Jones et al. | 367/25 |
| 2006/0254767 | A1 * | 11/2006 | Pabon et al. | 166/254.2 |
| 2009/0072832 | A1 * | 3/2009 | He et al. | 324/324 |
| 2009/0129203 | A1 * | 5/2009 | Jones et al. | 367/25 |
| 2009/0160294 | A1 * | 6/2009 | Rastegar et al. | 310/339 |
| 2009/0194334 | A1 * | 8/2009 | Johnson et al. | 175/61 |

FOREIGN PATENT DOCUMENTS

| | | | |
|---|---|---|---|
| EP | 1467060 | A1 * | 10/2004 |
| GB | 2254921 | A * | 10/1992 |
| GB | 2411676 | A | 7/2005 |
| WO | WO 00/36268 | A1 | 6/2000 |

* cited by examiner

--Prior Art--

APPARATUS AND METHOD FOR GENERATING POWER DOWNHOLE

BACKGROUND OF THE INVENTION

The present disclosure relates generally to the field of power generation and more particularly to downhole power generation.

Electrical power for use in the downhole drilling environment may be supplied by batteries in the downhole equipment or by downhole fluid driven generators. Downhole fluid driven generators are prone to reliability issues. Downhole batteries may suffer reliability problems at high and low temperatures.

BRIEF DESCRIPTION OF THE DRAWINGS

A better understanding of the present invention can be obtained when the following detailed description of example embodiments are considered in conjunction with the following drawings, in which.

Figure 1:
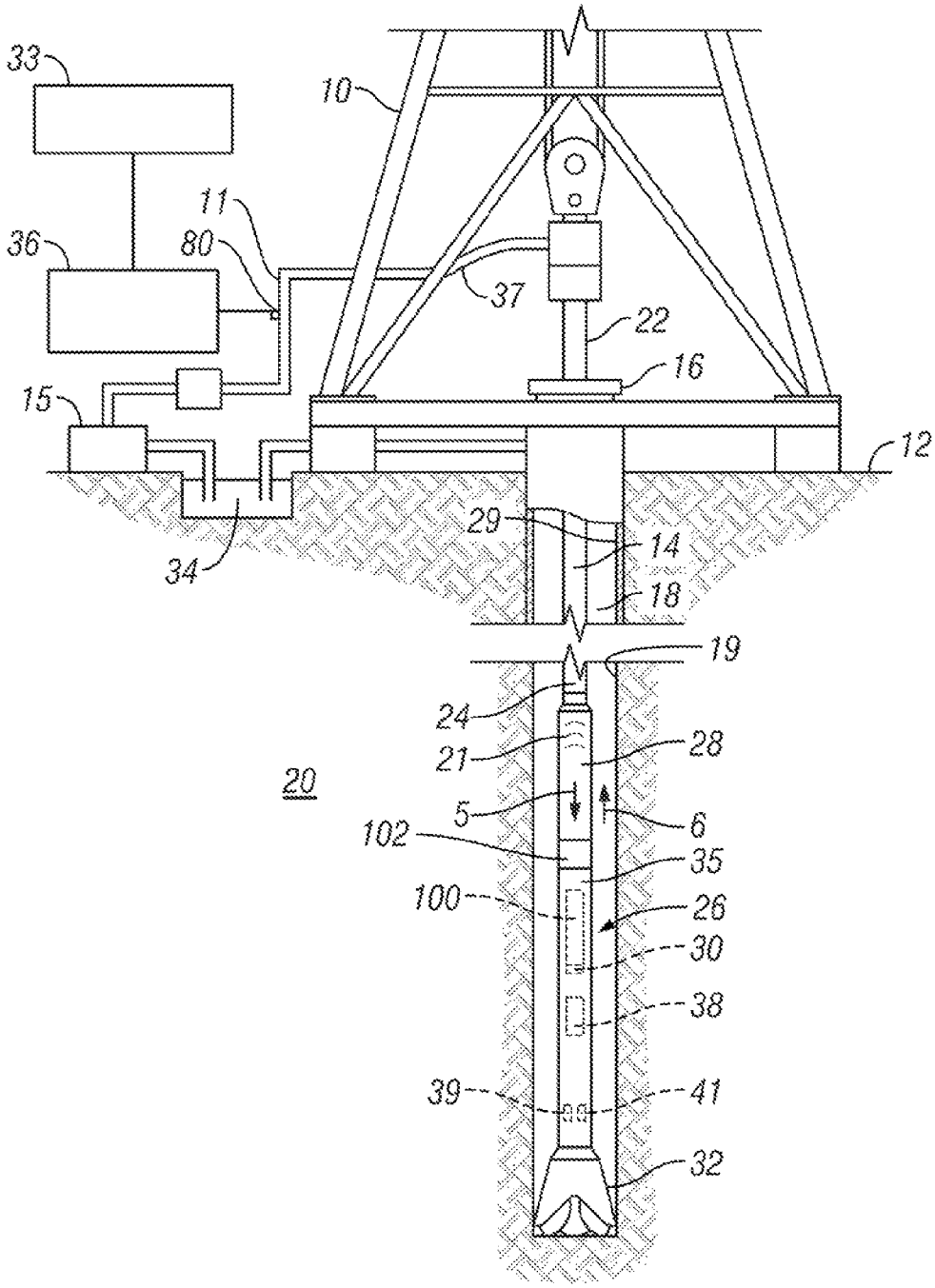
FIG. 1 is a schematic of a drilling installation.

While the invention is susceptible to various modifications and alternative forms, specific embodiments thereof are shown by way of example in the drawings and will herein be described in detail. It should be understood, however, that the drawings and detailed description thereof are not intended to limit the invention to the particular form disclosed, but on the contrary, the intention is to cover all modifications, equivalents and alternatives falling within the scope of the present invention as defined by the appended claims.

DETAILED DESCRIPTION

Described below are several illustrative embodiments of the present invention. They are meant as examples and not as limitations on the claims that follow.

Referring to FIG. 1, a drilling installation is illustrated which includes a drilling derrick 10, constructed at the surface 12 of the well, supporting a drill string 14. The drill string 14 extends through a rotary table 16 and into a borehole 18 that is being drilled through earth formations 20. The drill string 14 may include a kelly 22 at its upper end, drill pipe 24 coupled to the kelly 22, and a bottom hole assembly 26 (BHA) coupled to the lower end of the drill pipe 24. The BHA 26 may include drill collars 28, an MWD tool 30, and a drill bit 32 for penetrating through earth formations to create the borehole 18. In operation, the kelly 22, the drill pipe 24 and the BHA 26 may be rotated by the rotary table 16. Alternatively, or in addition to the rotation of the drill pipe 24 by the rotary table 16, the BHA 26 may also be rotated, as will be understood by one skilled in the art, by a downhole motor (not shown). The drill collars add weight to the drill bit 32 and stiffen the BHA 26, thereby enabling the BHA 26 to transmit weight to the drill bit 32 without buckling. The weight applied through the drill collars to the bit 32 permits the drill bit to crush the underground formations.

As shown in FIG. 1, BHA 26 may include an MWD tool 30, which may be part of the drill collar section 28. As the drill bit 32 operates, drilling fluid (commonly referred to as "drilling mud") may be pumped from a mud pit 34 at the surface by pump 15 through standpipe 11 and kelly hose 37, through drill string 14, indicated by arrow 5, to the drill bit 32. The drilling mud is discharged from the drill bit 32 and functions to cool and lubricate the drill bit, and to carry away earth cuttings made by the bit. After flowing through the drill bit 32, the drilling fluid flows back to the surface, indicated by arrow 6, through the annular area between the drill string 14 and the borehole wall 19, or casing wall 29. At the surface, it is collected and returned to the mud pit 34 for filtering. In one example, the circulating column of drilling mud flowing through the drill string may also function as a medium for transmitting pressure signals 21 carrying information from the MWD tool 30 to the surface. In one embodiment, a downhole data signaling unit 35 is provided as part of MWD tool 30. Data signaling unit 35 may include a pressure signal transmitter 100 for generating the pressure signals transmitted to the surface.

MWD tool 30 may include sensors 39 and 41, which may be coupled to appropriate data encoding circuitry, such as an encoder 38, which sequentially produces encoded digital data electrical signals representative of the measurements obtained by sensors 39 and 41. While two sensors are shown, one skilled in the art will understand that a smaller or larger number of sensors may be used without departing from the principles of the present invention. The sensors 39 and 41 may be selected to measure downhole parameters including, but not limited to, environmental parameters, directional drilling parameters, and formation evaluation parameters. Such parameters may comprise downhole pressure, downhole temperature, the resistivity or conductivity of the drilling mud and earth formations, the density and porosity of the earth formations, as well as the orientation of the wellbore.

The MWD tool 30 may be located proximate to the bit 32. Data representing sensor measurements of the parameters discussed may be generated and stored in the MWD tool 30. Some or all of the data may be transmitted by data signaling unit 35, through the drilling fluid in drill string 14. A pressure signal travelling in the column of drilling fluid may be detected at the surface by a signal detector unit 36 employing a pressure detector 80 in fluid communication with the drilling fluid. The detected signal may be decoded in information handling system 33. For purposes of this disclosure, an information handling system may comprise any instrumentality or aggregate of instrumentalities operable to compute, classify, process, transmit, receive, retrieve, originate, switch, store, display, manifest, detect, record, reproduce, handle, or utilize any form of information, intelligence, or data for scientific, control, or other purposes. The pressure signals may comprise encoded binary representations of measurement data indicative of the downhole drilling parameters and formation characteristics measured by sensors 39 and 41. Information handling system 33 may be located proximate the rig floor. Alternatively, information handling system 33 may be located away from the rig floor. In one embodiment, information handling system 33 may be incorporated as part of a logging unit. Alternatively, other types of telemetry signals may be used for transmitting data from downhole to the surface. These include, but are not limited to, electromagnetic waves through the earth and acoustic signals using the drill string as a transmission medium. In yet another alternative, drill string may comprise wired pipe enabling electric and/or optical signals to be transmitted between downhole and the surface.

In one example, a generator 102 provides electrical power and may be located in BHA 26 to provide at least a portion of the electrical power required by the various downhole electronics devices and/or sensors.

Also referring to FIGS. 2A-2D, in one example, generator 102 comprises a tubular body 202 that may be coupled into drill string 14. Flow passage 201 provides a passage for the flow of drilling fluid through body 202. In this example, the axis 203 of flow passage 201 is approximately coincident with the axis of rotation of the drill string proximate body 202. A plurality of longitudinal cavities 230 may be formed around the outer circumference of tubular member 202. In the example shown, six cavities 230 are formed around tubular member 202. Alternatively, a greater or fewer number of cavities may be formed around tubular member 202. A piezoelectric assembly 212 may be disposed in each cavity 230. For example, piezoelectric assemblies 212*a-f* may be disposed in cavities 230*a*-230*f*, respectively.

In one embodiment, each piezoelectric assembly 212 may comprise a stack of piezoelectric elements 211 encased in flexible potting material 210. In one embodiment, each piezoelectric element 211 is separated by an adjacent piezoelectric element 211 by a distance L. The intermediate space between each adjacent element may be filled with flexible potting material 210. In one example, approximately the same thickness of potting material 210 separates the bottom piezoelectric element from the bottom of cavity 230.

In one embodiment, piezoelectric element 211 comprises a piezoelectric film material. Examples include, but are not limited to, polyvinylidene fluoride (PVDF) and copolymers, such as a copolymer of PVDF and trifluoroethylene, and a copolymer of PVDF and tetrafluoroethylene. Alternatively, piezoelectric element 211 may comprise a piezoelectric ceramic material such as lead zirconium titanate (PZT) and barium titanate ($BATiO_3$), or a piezoelectric crystalline material, for example, quartz, or any other material that exhibits piezoelectric properties. In yet another embodiment, piezoelectric element 211 may comprise a piezoelectric fiber-composite material.

Figure 2A:
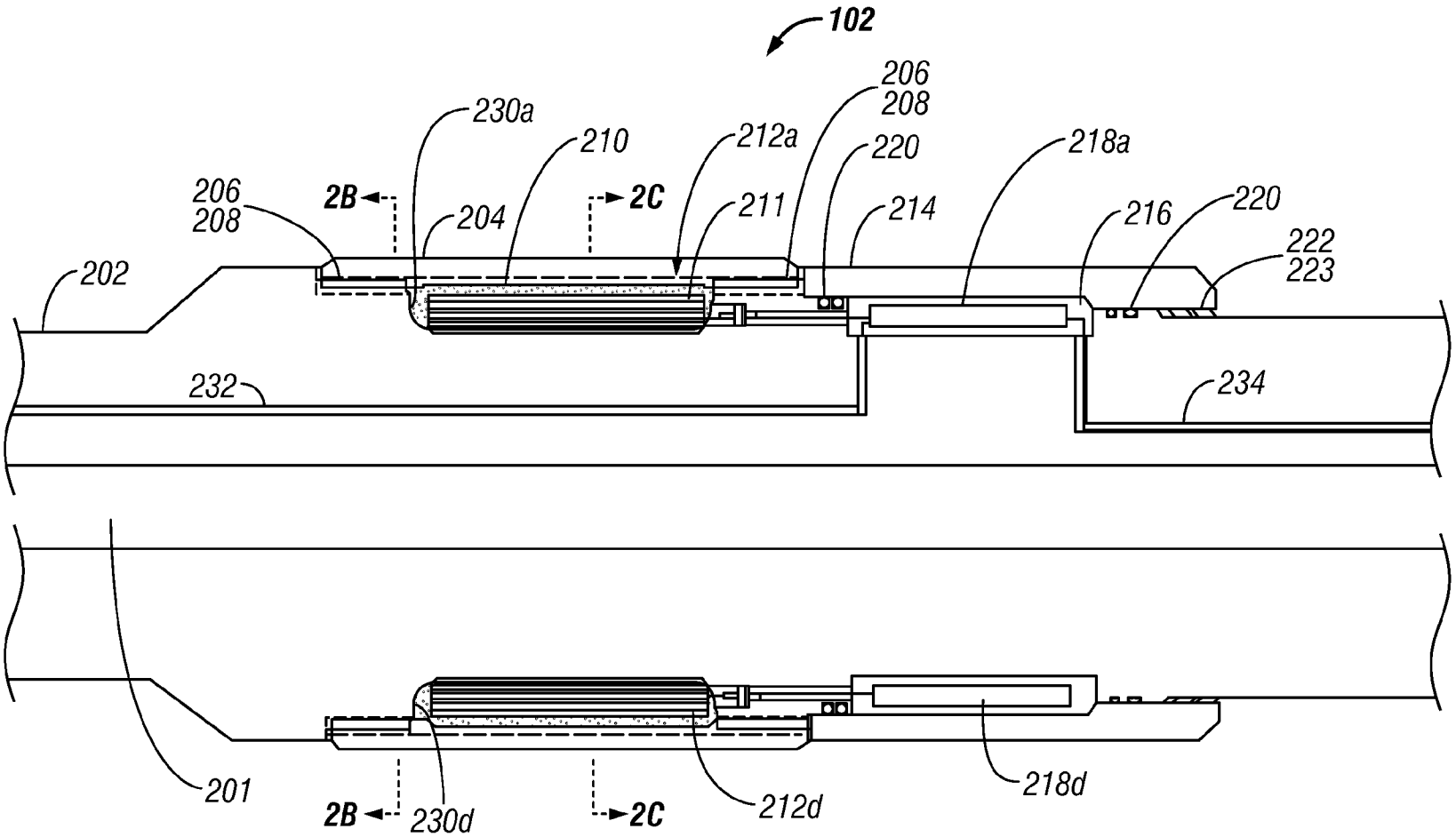
FIG. 2A is a view of an example embodiment of a downhole generator.
Figure 2B:
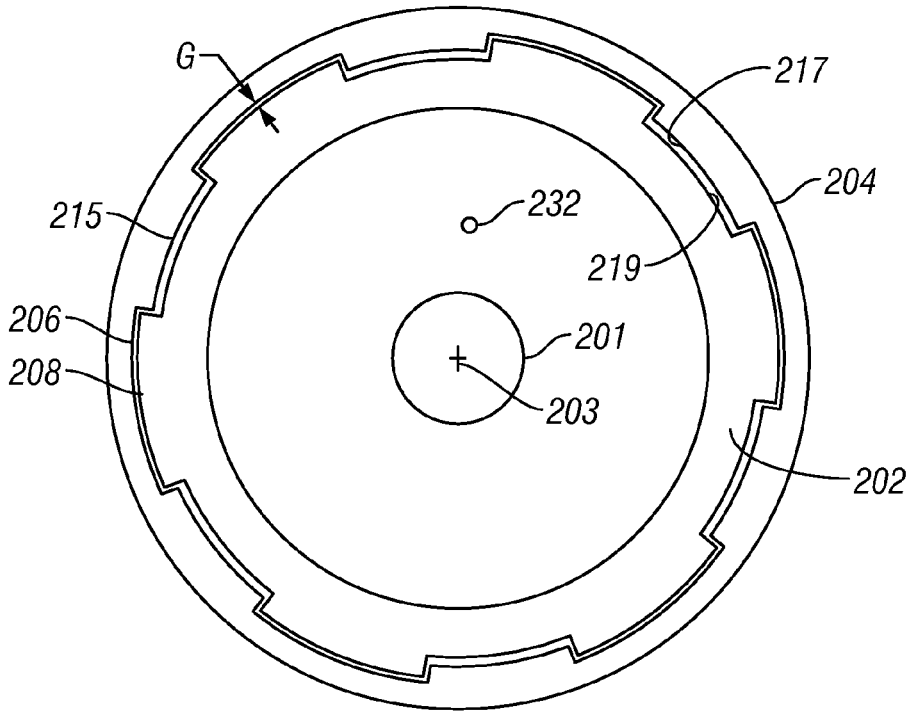
FIG. 2B is a cross-section of the downhole generator of FIG. 2A.
Figure 2C:
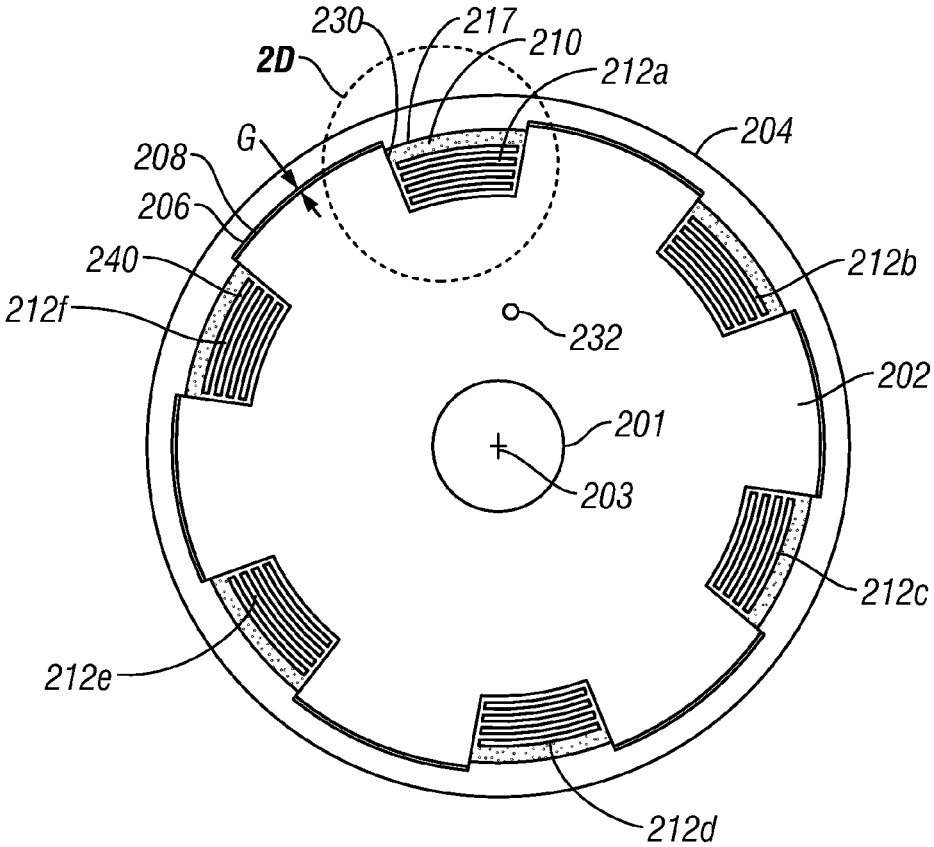
FIG. 2C is another cross-section of the downhole generator of FIG. 2A.
Figure 2D:
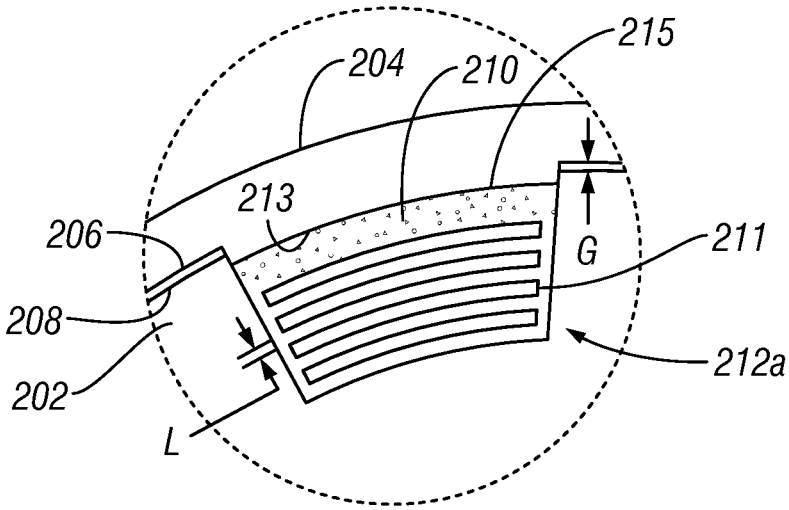
FIG. 2D is an enlarged view of bubble 2D of FIG. 2C.

In one example, cover 204 is a substantially cylindrical member that fits around the section of tubular body 202 housing the piezoelectric assemblies 212. Cover 204 extends in each axial direction, beyond cavity 230 and has an internal spline 206 formed on at least a portion of inner surface 217 thereof. Internal spline 217 engages a mating external spline 208 formed on an outer surface 219 of body 202. As shown in FIGS. 2B-2D, spline 206 is sized such that there is a gap, G, between the inner surface 217 of spline 206 and the outer surface 219 of spline 208. Gap, G, allows cover 204 to move radially due to interaction of cover 204 with the borehole wall 19. In one example, flexible potting material 210 extends outward to contact spline surface 215 of cover 204. Flexible potting material 210 may be adhered to the bottom of spline surface 215 by a suitable adhesive material 213. Alternatively, potting material 210 may not be adhered to spline surface 215.

Figure 8:
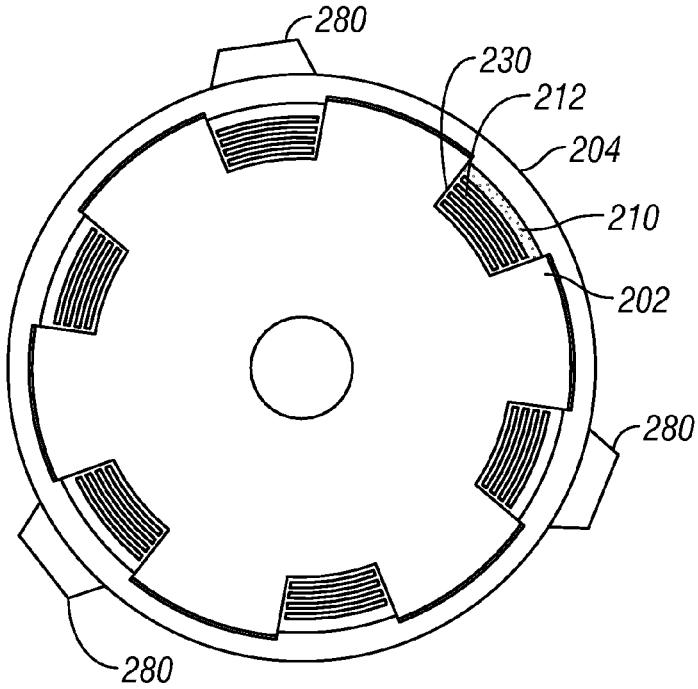
FIG. 8 is an example of a downhole generator with blades on an outer surface of a cover.

In another embodiment, see FIG. 8, at least one blade 280 is attached to the outside of cover 204 to enhance contact with the borehole wall. While shown with three blades 280, any number of blades may be used. Attachment may be by any suitable mechanical process, including, but not limited to, mechanical fasteners, welding, and brazing. Alternatively, at least one blade may be formed integrally to the outside of cover 240 using any suitable forming process. For example, the cover and the at least one blade may be machined from a single bar.

Figure 3:
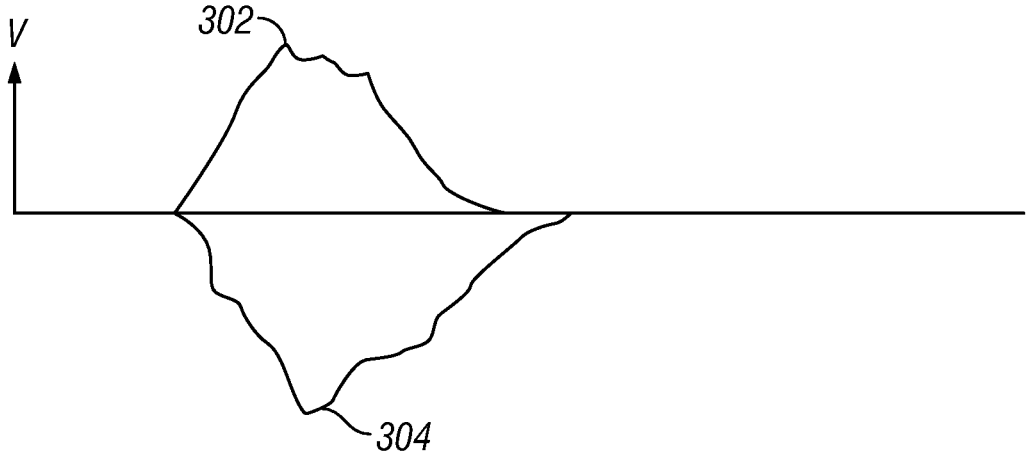
FIG. 3 shows examples of voltages generated by a piezoelectric generator.

In one example during drilling operations, drill string 14 and/or drill collar section 28 rotates. During rotation, cover 204 may be forced radially into contact with borehole wall 19. This contact will cause cover 204 to move radially with respect to body 202 causing compression of piezoelectric element assembly 212 and generating a voltage increase 302, see FIG. 3, across the piezoelectric elements 211. As cover 204 moves away from the wall, cover 204 may move back to a neutral position with the voltage of the piezoelectric assembly returning to its base level 300. If the potting material in each cavity 230 is adhered to spline surface 215 in each cavity 230, the compression on one side of cover 204 results in cover 204 stretching the piezoelectric assembly on the opposite side of body 202, resulting in a negative voltage 304. Similarly, as cover moves away from the wall, cover 204 may move back to a neutral position with the voltage 304 of the piezoelectric assembly returning to its base level 300. In the case where the potting compound is not adhered to spline surface 217, only compression is applied to piezoelectric elements 211 such that only the positive voltage 302 is generated.

In another drilling example, body 202 may experience cyclical bending stresses such that body 202 deflects with respect to cover 204. Such cyclic motion produces simultaneous cyclical compression and tension on piezoelectric element assemblies 212 on opposite sides of body 202, if piezoelectric element assemblies 212 are adhesively coupled to cover 204. The cyclical loading will produce cyclical positive and negative voltages that may be fed into suitable circuitry for use downhole.

Figure 4:
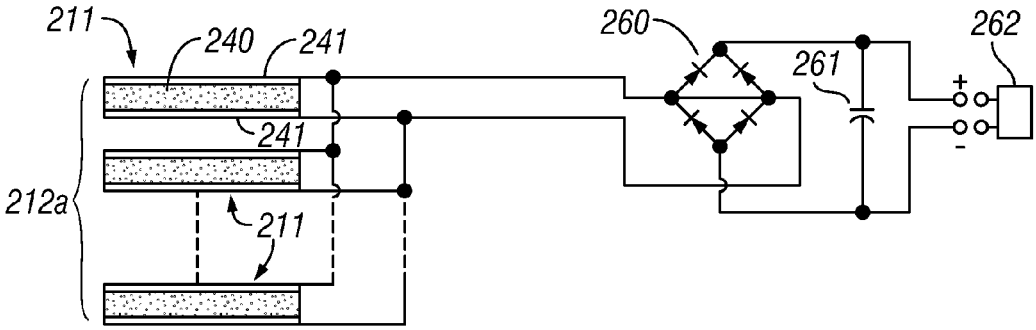
FIG. 4 is a schematic showing one example of a circuit for converting power generated by piezoelectric elements.

In one example, also referring to FIG. 4, each piezoelectric element 211 comprises piezoelectric material 240 described previously. Piezoelectric material 240 has a conductive material 241 disposed on the upper and lower surfaces thereof. As loads are applied to piezoelectric assembly 212, the voltage/charge generated is fed in parallel from each piezoelectric element 211 to a rectifier 260, through a smoothing/filter capacitor, and to load 262. Load 262 may comprise additional electronic circuits 218, housed in electronics cavity 216. Electronics cavity 216 may be a longitudinal cavity similar to cavity 230. Alternatively, electronics cavity 216 may encompass the circumferential volume around body 202. Circuits 216 may comprise voltage converters, a processor, and a memory in data communication with the processor for storing programmed instructions to control the energy storage and/or distribution to other downhole devices and/or tools in drill string 14. In one example, power from piezoelectric element assemblies 212 may be used to charge capacitors and/or rechargeable batteries.

Wires (not shown) may be run in passages 232 and 234 to power other devices in body 202 and/or in other downhole systems external to body 202 via suitable connectors. Electronics cover 214 fits over electronics cavity 216 and seals electronics cavity 216 from the external environment via seals 220. In one example electronics cover 214 is threaded onto body 202 by threads 222 and 223 formed on electronic cover 214 and body 202, respectively. In one embodiment, a plurality of generators 102 may be connected to a common electrical bus for combining power from the generators 102, when higher power is required.

Figure 5A:
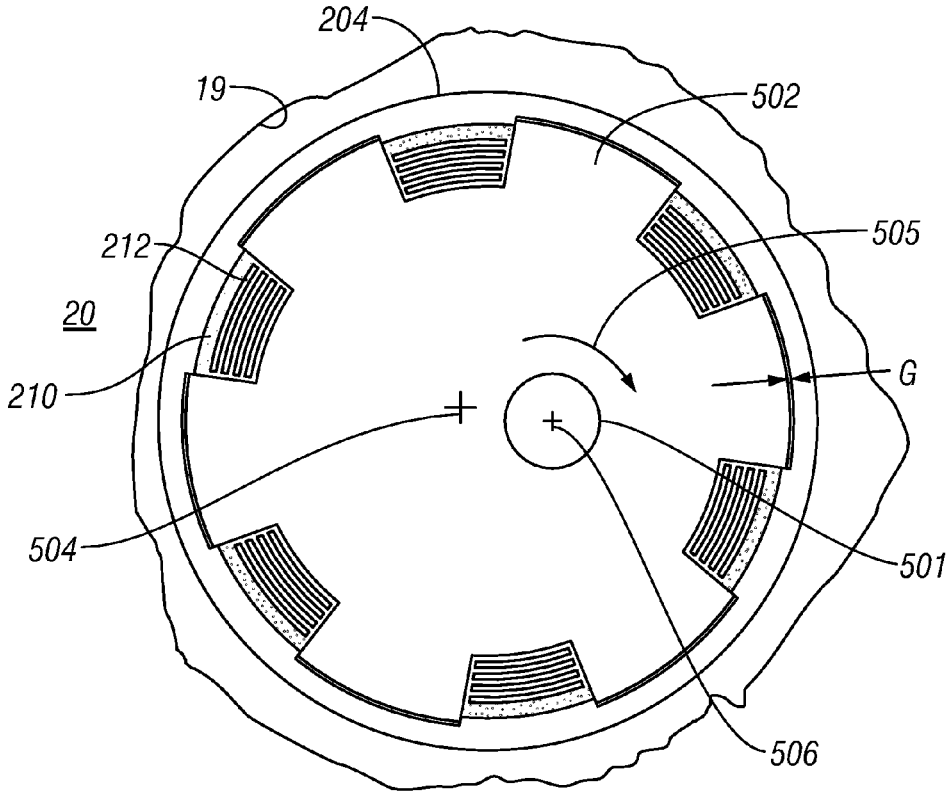
FIG. 5A is a view illustrating an example of an eccentric body for use in a downhole generator.

In one embodiment, also referring to FIG. 5A, body 502 is formed such that the center 504 of body 502 is displaced from the center 506 of rotation 506 of drill string 14. This forms an eccentric body that is substantially always in contact with the borehole wall 19 thereby generating electric power. In this example, flow passage 501 is approximately concentric with the axis of rotation of drill string 14 proximate body 502.

Figure 5B:
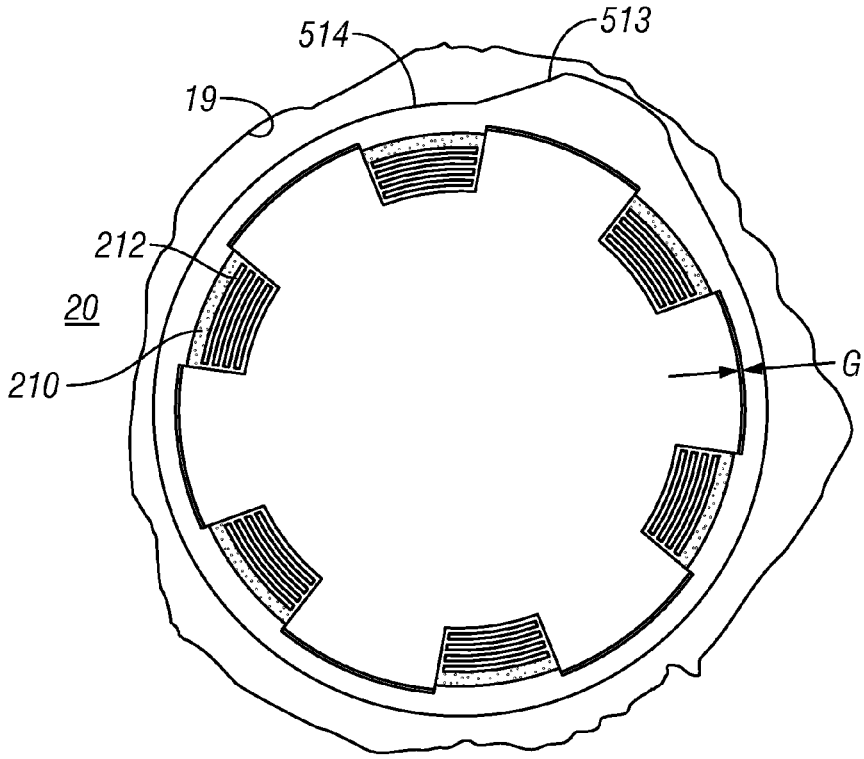
FIG. 5B is a view illustrating an example of an eccentric sleeve for use in a downhole generator.
Figure 5C:
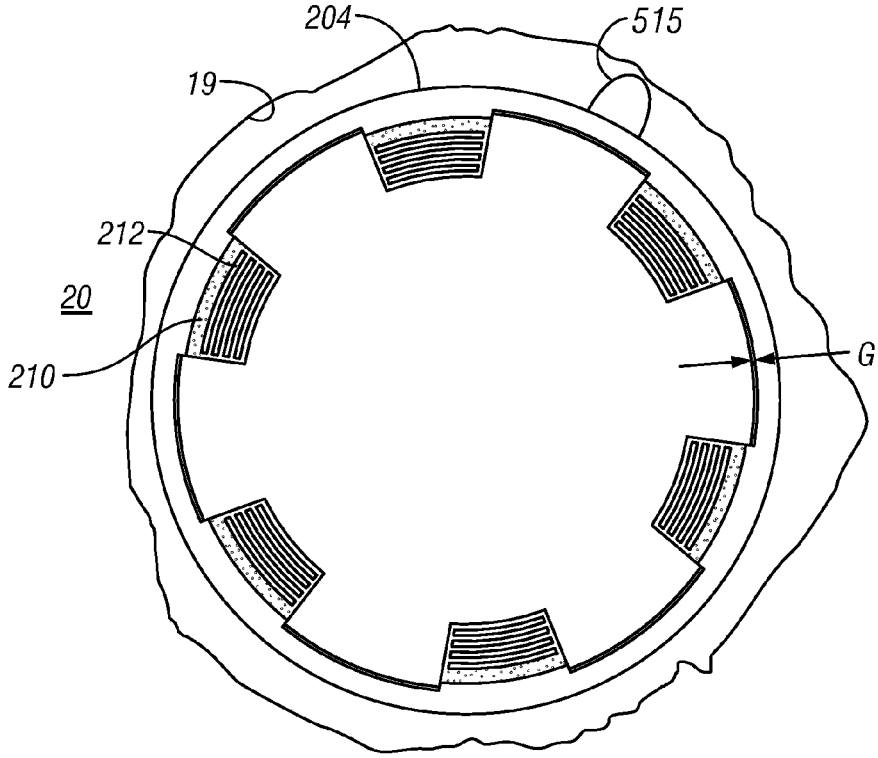
FIG. 5C is a view illustrating an example of a sleeve having a single external blade for use in a downhole generator.

In another embodiment, see FIG. 5B, an eccentric section 513 is formed on sleeve 514 using techniques known in the art. Eccentric section 513 extends outward from sleeve 514 and contacts borehole wall 19 as drill string 14 rotates thereby generating electric power. Alternatively, see FIG. 5C, a single blade 515 may be attached to sleeve 204 to effect an eccentric geometry such that rotation of drill string 14 causes blade 515 into contact with borehole wall 19 thereby generating electric power.

Figure 6A:
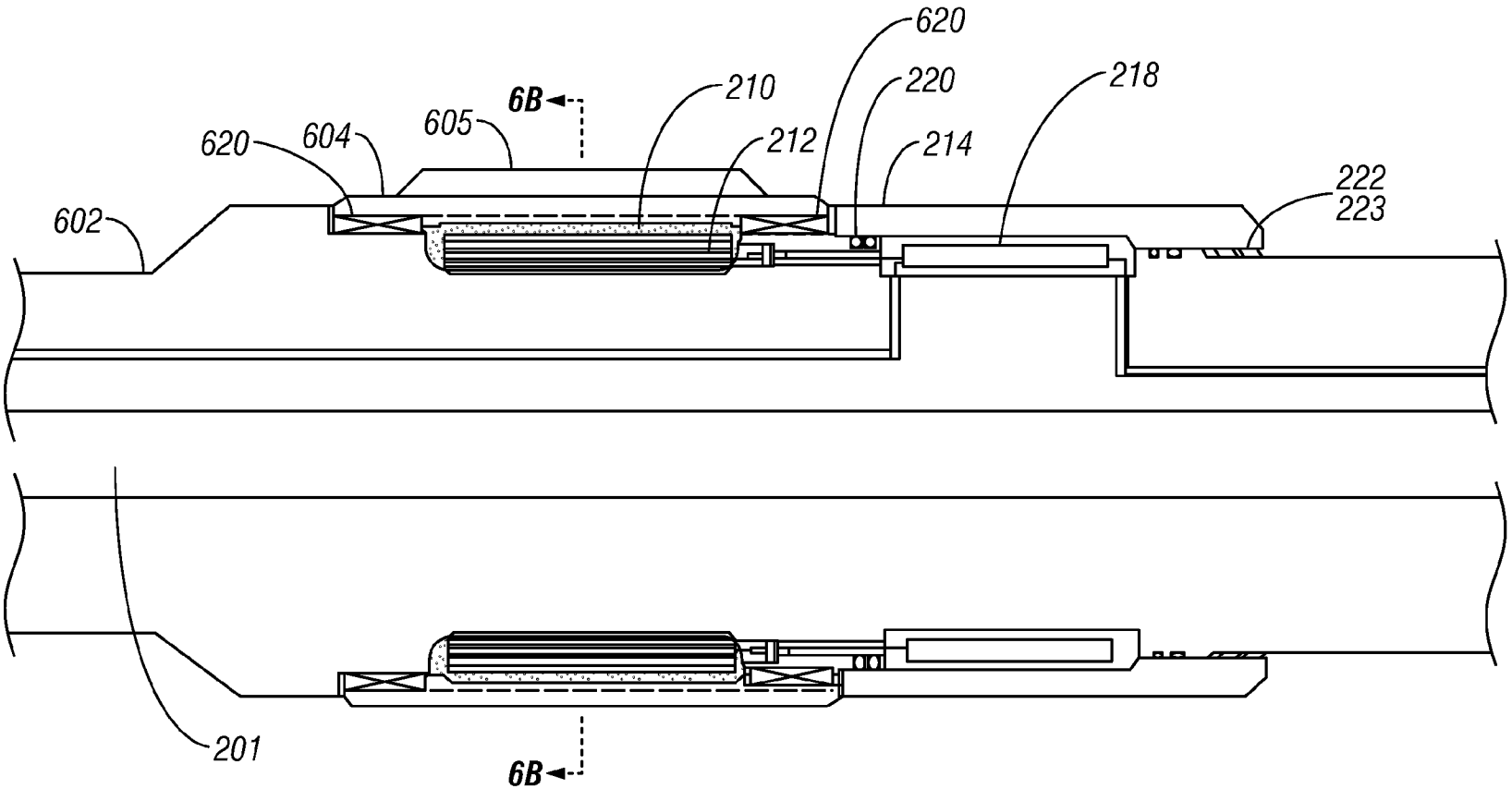
FIG. 6A is an example of a downhole generator having a bearing mounted cover.
Figure 6B:
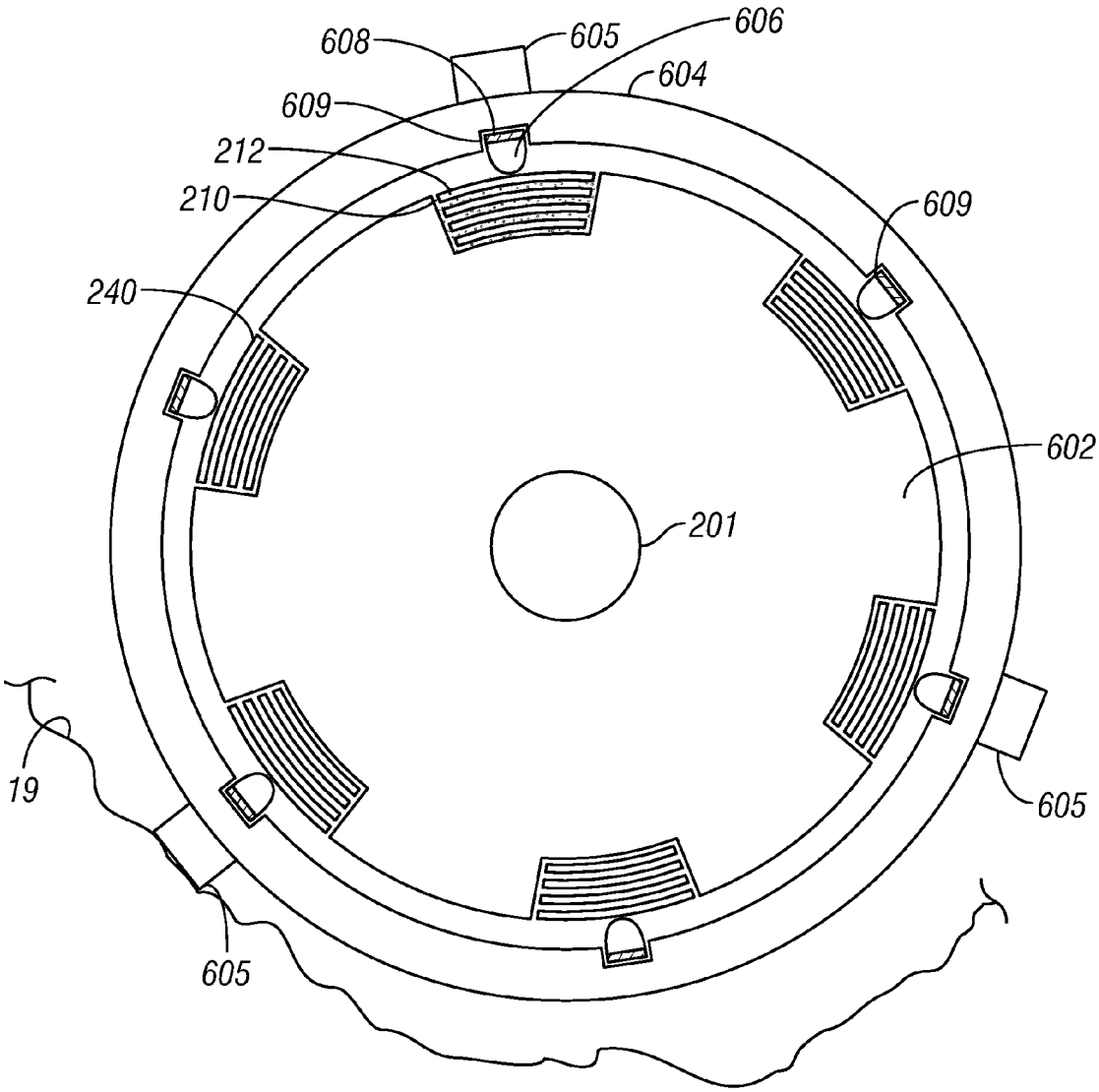
FIG. 6B is a section of the downhole generator of FIG. 6A showing internal blades for activating the piezoelectric element assemblies.

In another embodiment, referring to FIGS. 6A and 6B, cover 604 is mounted on bearings 620 such that cover 604 and body 602 are rotatable relative to each other. A plurality of stabilizer blades 605 may be attached or integrally formed on cover 604. Blades 605 may be straight blades, as shown in FIG. 6B, spiral blades known in the art, or any other suitable blade geometry. In one example, at least one of blades 605 may contact borehole wall 19 such that cover 604 and blades 605 are substantially stationary with respect to borehole wall 19. As shown in FIG. 6B, at least one internal blade 606 may be positioned in an internal cavity 609 in cover 604. A spring 608 forces internal blade 606 into contact with piezoelectric element assembly 212 during rotation of body 602 by drill string 14. The contact of internal blade 606 causes compression of piezoelectric element assembly 212 causing generation of a voltage/charge that may be collected as described previously. As shown, multiple internal blades 606 may be positioned around cover 604 to increase the frequency of contact of internal blades 606 with piezoelectric element assemblies 212. Spring 608 may be an elastomer spring or a metallic spring, for example a leaf spring.

Figure 7:
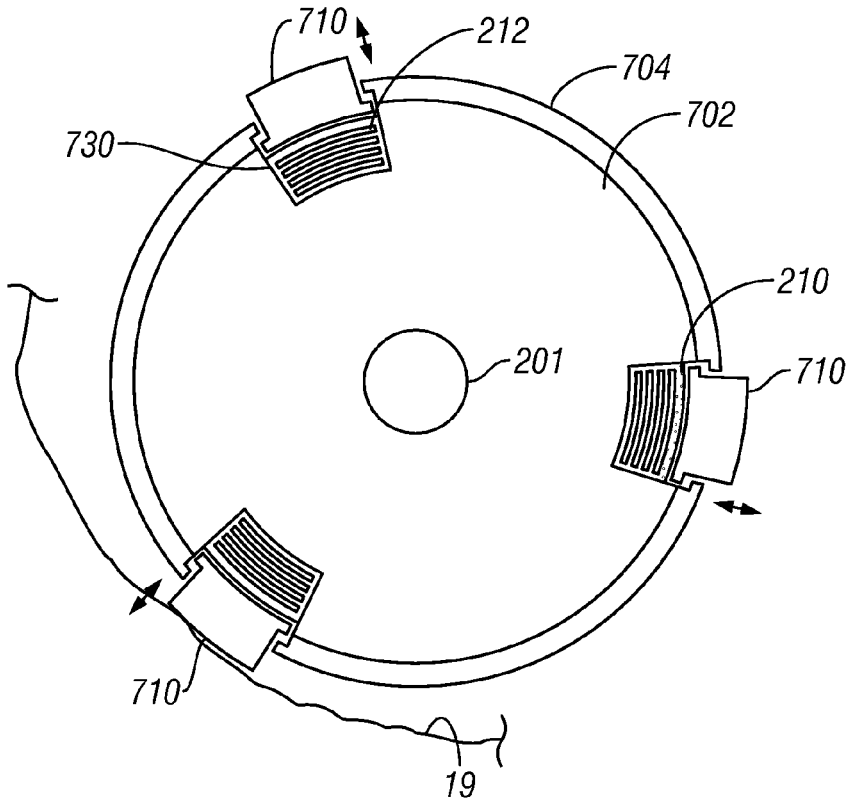
FIG. 7 is an example of a downhole generator comprising radially moving blades interacting with piezoelectric elements.

In yet another embodiment, referring to FIG. 7, body 702 has at least one longitudinal cavity 730 formed therein that accepts a piezoelectric element assembly 212, previously described. A blade 710 may be disposed in contact with a potting material 210, previously described, such that radial motion of blade 710, for example, due to interaction of at least one blade 710 with borehole wall 19 causes compression of piezoelectric element assembly 212 thereby generating electric power. Three blades 710 are shown in FIG. 710. Any suitable number of blades, including a single blade, may be used.

Figure 9:
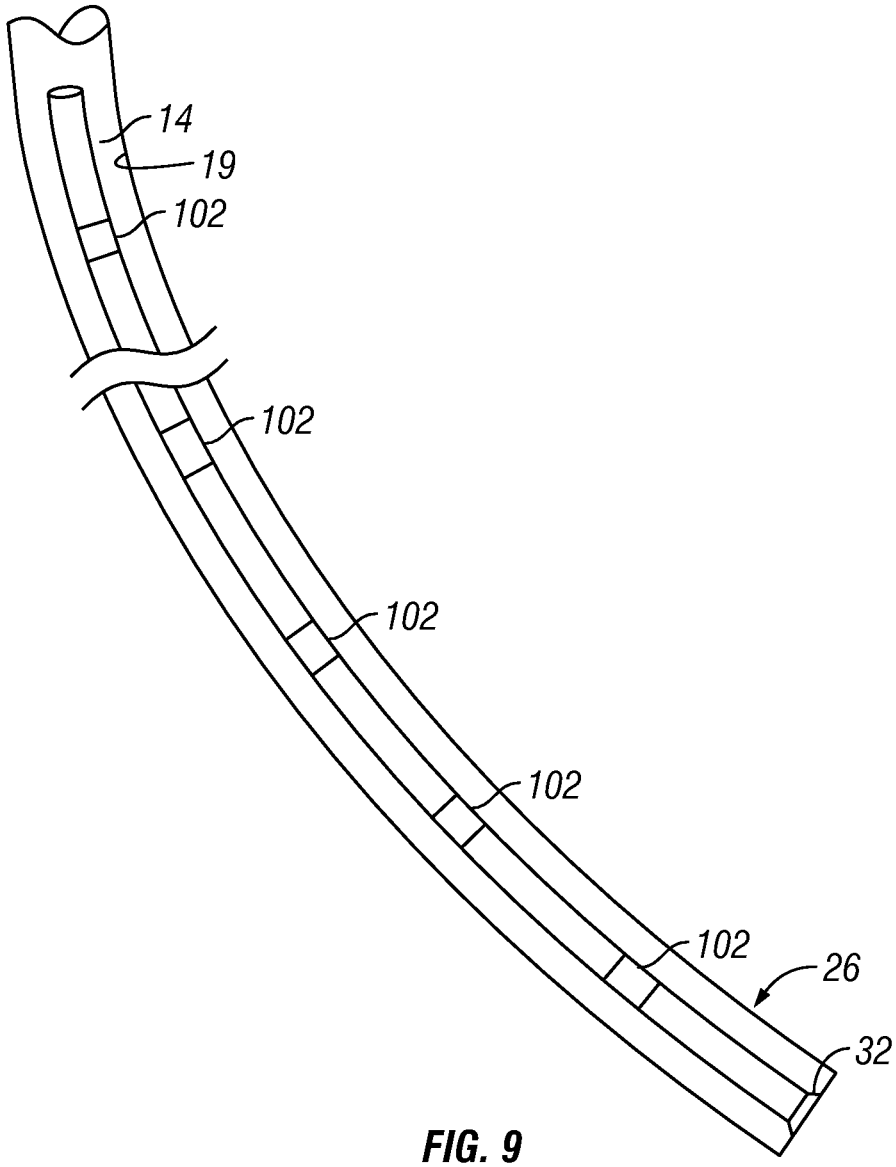
FIG. 9 shows a drill string having a plurality of spaced apart generators distributed therein.

While generator 102 is described herein as located in BHA 26, it will be appreciated that a plurality of generators 102 may be spaced out within drill string 14, see FIG. 9. Each generator 102 may contain sensors and a telemetry transmitter and/or receiver.

One skilled in the art will appreciate that the amount of power generated is related to the number of piezoelectric element assemblies in a particular body. In addition, as described previously, any number of generator bodies may be electrically connected to a common power bus to provide additional power. For example, the embodiments described above may be configured to generate on the order of 20-100 milliwatts for use, for example, in a repeater configuration, and up to about 20 watts for powering, for example, devices in a BHA.

One skilled in the art will appreciate that, the stacking of the piezoelectric elements may be accomplished using different orientations, for example, a longitudinal stacking. In one embodiment, both longitudinal and radial stacking may be used to enhance the generation of electrical power from multiple vibration modes and sources. In one embodiment, transient torsional motion, for example stick-slip motion, may interact with and deform the potting material to impart compression and/or tension loads on the piezoelectric elements, in any of the configurations described above, to generate electrical power.

Numerous variations and modifications will become apparent to those skilled in the art. It is intended that the following claims be interpreted to embrace all such variations and modifications.

What is claimed is:

1. A downhole power generator comprising:

a substantially tubular body;

a cover surrounding at least a portion of the body;

at least one piezoelectric element disposed in the body, the piezoelectric element engaged with the cover such that radial motion of the cover relative to the body causes the piezoelectric element to generate electric power.

2. The downhole power generator of claim 1 wherein the at least one piezoelectric element comprises a material chosen from the group consisting of: a piezoelectric film, a piezoelectric ceramic, a piezoelectric crystalline material, and a piezoelectric fiber-composite material.

3. The downhole power generator of claim 1 wherein the at least one piezoelectric element comprises a plurality of piezoelectric elements.

4. The downhole power generator of claim 3 wherein the plurality of piezoelectric elements are encased in a potting material forming a piezoelectric assembly.

5. The downhole power generator of claim 4 further comprising a plurality of piezoelectric assemblies disposed circumferentially around the body.

6. The downhole power generator of claim 3 further comprising at least one radially movable blade engaged with the at least one of the plurality of piezoelectric elements such that radial motion of the at least one blade relative to the body causes the piezoelectric element to generate electric power.

7. The downhole power generator of claim 6 wherein the at least one of the plurality of piezoelectric elements are encased in a potting material forming at least one piezoelectric assembly.

8. The downhole power generator of claim 7 where in the load is transmitted to the at least one piezoelectric assembly by the potting material.

9. The downhole power generator of claim 1 further comprising an external spline formed on an outer surface of the body and an internal spline formed on an inner surface of the cover, the external spline and the internal spline acting cooperatively to prevent substantial rotation of the cover with respect to the body.

10. The downhole power generator of claim 1 further comprising at least one blade on an outer surface of the cover.

11. The downhole power generator of claim 1 further comprising a processor and a memory in data communication with the processor.

12. A method for generating power downhole comprising:

disposing a cover around at least a portion of a substantially tubular body;

disposing at least one piezoelectric element in the body; and engaging the piezoelectric element with the cover such that radial motion of the cover relative to the body causes the piezoelectric element to generate electric power.

13. The method of claim 12 wherein the piezoelectric element comprises a material chosen from the group consisting of: a piezoelectric film, a piezoelectric ceramic, a piezoelectric crystalline material, and a piezoelectric fiber-composite material.

14. The method of claim 12 wherein the at least one piezoelectric element comprises a plurality of piezoelectric elements.

15. The method of claim 14 further comprising encasing the plurality of piezoelectric elements in a potting material forming a piezoelectric assembly.

16. The method of claim 15 further comprising disposing a plurality of piezoelectric assemblies circumferentially around the body.

17. The method of claim 12 further comprising forming an external spline on an outer surface of the body and an internal spline on an inner surface of the cover, the external spline and the internal spline acting cooperatively to prevent substantial rotation of the cover with respect to the body.

18. The method of claim 12 further comprising disposing at least one blade on an outer surface of the cover.

* * * * *